US005400467A

United States Patent [19]

Hwang

[11] Patent Number: 5,400,467

[45] Date of Patent: Mar. 28, 1995

[54] SUCTION HEAD OF VACUUM CLEANER

[75] Inventor: Jin-Sung Hwang, Suwon, Rep. of Korea

[73] Assignee: Samsung Electronics Co., Ltd., Suwon, Rep. of Korea

[21] Appl. No.: 103,136

[22] Filed: Aug. 9, 1993

[30] Foreign Application Priority Data

Aug. 12, 1992 [KR] Rep. of Korea ..... UM92-15112

[51] Int. Cl.[6] ..... A47L 13/12

[52] U.S. Cl. ..... 15/364; 15/322; 15/388; 15/401

[58] Field of Search ..... 15/320, 321, 322, 388, 15/364

[56] References Cited

U.S. PATENT DOCUMENTS 4,369,544 1/1983 Parisi ..... 15/320

4,433,451 2/1984 Parisi ..... 15/322 X 5,241,724 9/1993 Lim ..... 15/388 X 5,301,387 4/1994 Thomas et al. ..... 15/393 X

*Primary Examiner*—Christopher K. Moore

*Attorney, Agent, or Firm*—Burns, Doane, Swecker & Mathis

[57] ABSTRACT

A suction head for a vacuum cleaner includes a rag roll device which is wetted to perform a wet wiping action across the floor. The rag roll device is mounted for rotation about a horizontal axis. A rotation regulating mechanism, comprised of a pawl device and ratchet teeth, is provided which prevents the rag roll device from rotating when the suction head is moved forwardly, while permitting the rag roll device to rotate by a predetermined angle when the suction head is moved rearwardly. This enables different portions of the rag roll device to assume a floor-contacting position.

10 Claims, 4 Drawing Sheets

SUCTION HEAD OF VACUUM CLEANER

BACKGROUND OF THE INVENTION

1. Field of the Invention

The present invention relates to a suction head of a vacuum cleaner, and more particularly to a suction head of a vacuum cleaner having a wet rag for wiping a floor to be cleaned.

2. Description of the Prior Art

An example of a suction head for a conventional cleaner is provided in a Japanese laid-open patent application NO. Showa 57-185824 in which a rotary brush of a vacuum cleaner is described which has an exchangeable rotary brush.

Meanwhile, in a suction head of a cleaner having a rotary brush thus constructed, dust on the floor can be sucked in but the floor cannot be cleaned to the same extent as an be performed with a wet rag.

In order to solve the aforementioned problems, a suction head of a cleaner as illustrated in FIG. 1 has been conventionally used. As illustrated in FIG. 1, a rag member 3 is attached to a lower area of an attachment panel 2 formed with a plurality of holes 2*a* by a fastening means (not shown). This panel 2 is fixed by a fixing means or a mechanical indentation (not shown) to a lug 4*a* inwardly and protrudingly formed within a rag holder 4 that is integrally formed on an approximate center of the suction head 1.

Furthermore, a cleansing water auxiliary tank 6 is formed between a frontal wall 4*b* of the rag holder 4 and a bulkhead 5 and the cleansing water is supplied to the tank 6 through a cleansing water supply tube 7.

A guiding means 9 is disposed on an upper opening of the auxiliary tank in order to guide the dust and air sucked in from a main suction port 13 (mentioned later) to a suction tube 8, and a space 10 is formed between the guiding means 9 and the attachment panel 2.

Meanwhile, a lower hole 6*a* is formed on the frontal wall 4*b* of the auxiliary tank 6, so that the cleansing water W supplied through the supply tube 7 can be supplied to a rag member 3 along an arrow direction S.

An upper hole 6*b* is formed on the frontal wall 4*b* of the auxiliary tank 6, so that the cleansing water W of the supply tube 7 can be discharged to the space 10 formed between the guiding means 9 and the attachment panel 2 to thereby allow the water W to be supplied to the rag member 3 along an arrow direction R through the holes 2*a* formed on the attachment panel 2, A caster 12 is disposed on a frontal lower area of the suction head 1, so that the caster rotates freely on a shaft installed on left/right walls of the suction head 1, and the main suction port 13 is formed on a rear side of the caster 12 in order to suck in the dust, wastes or the like.

A wiper blade 14 made of an elastic material is clamped by a first clamp member 15 between the main suction hole 13 and the auxiliary tank 6 in order to collect the dust, wastes or the like toward the main suction port B, and at the rear of the rag member 3, there is formed an auxiliary suction port 16, so that moisture not suctionable by the rag member 3 can be sucked in.

Furthermore, between the auxiliary suction port 16 and a main caster 17, there is a wiper blade 18 made of an elastic material clamped by a second clamp member 19, so that moisture residual on the floor surface can be collected to thereby be sucked into the auxiliary suction port 16 after the floor is water-wiped by the rag member 3.

In the suction head of the cleaner thus constructed, when the vacuum cleaner is activated by an activation of a controlling unit (not shown), the dust, wastes or the like is sucked in through the main suction port 13 along an arrow direction P, and at the same time, the cleansing water W within the auxiliary tank 6 is supplied to the rag member 3 along the arrow direction S via a lower hole 6*a* formed on the frontal wall 4*b* of the rag holder 4 and simultaneously the water W can be supplied to the rag member along the arrow direction R through holes 2*a* formed on the attachment panel 2 via the space 10 formed by the guiding means 9 and an attachment pin 2 through the upper hole 6*b*, so that the floor can be wet rag-wiped.

However, because the rag member 3 attached within the rag holder 4 disposed on the central floor in the suction head i is not rotated, the contaminated materials smeared under the lower surface of the rag member 3 can re-contaminate the floor when the floor is being cleaned for a long time, resulting in a problem of the floor not effectively cleaned.

SUMMARY OF THE INVENTION

Accordingly, the present invention is provided to solve the aforesaid problems and therefore, it is an object of the present invention to provide a suction head of a vacuum cleaner with which a rag roll is mounted for rotation in one direction by a predetermined angle, so that re-contamination on the floor to be cleaned can be prevented and a clean wiping can be performed.

In accordance with the objects of the present invention, there is provided a suction head of a vacuum cleaner by which dust, wastes or the like is vacuum-cleaned with a suction pressure in accordance with a suction driving means within a body of the vacuum cleaner and at the same time a cleaning can be done with a wet rag, the suction head of a vaccum cleaner comprising: main and auxiliary suction ports for sucking in the dust, wastes or the like from the floor to be cleaned; a rag roll for wiping off the floor smeared with the dust or wastes by being disposed between the main and auxiliary suction ports; a rag roll support means for releasably supporting the rag roll; a main shaft for rotatably supporting the rag roll by being inserted into the rag roll support means; first and second control means having a plurality of teeth disposed in respectively reverse directions for controlling right/reverse rotations of the rag roll by being mounted on one end of a periphery of the main shaft; and a click means for regulating rotations of the first and second control means.

BRIEF DESCRIPTION OF THE DRAWINGS

Other object and aspects of the invention will become apparent from the following description of an embodiment with reference to accompanying drawings in which.

DETAILED DESCRIPTION OF THE INVENTION

Hereinafter, an embodiment of the present invention will be described in detail with reference to the accompanying drawings.

Figure 1:
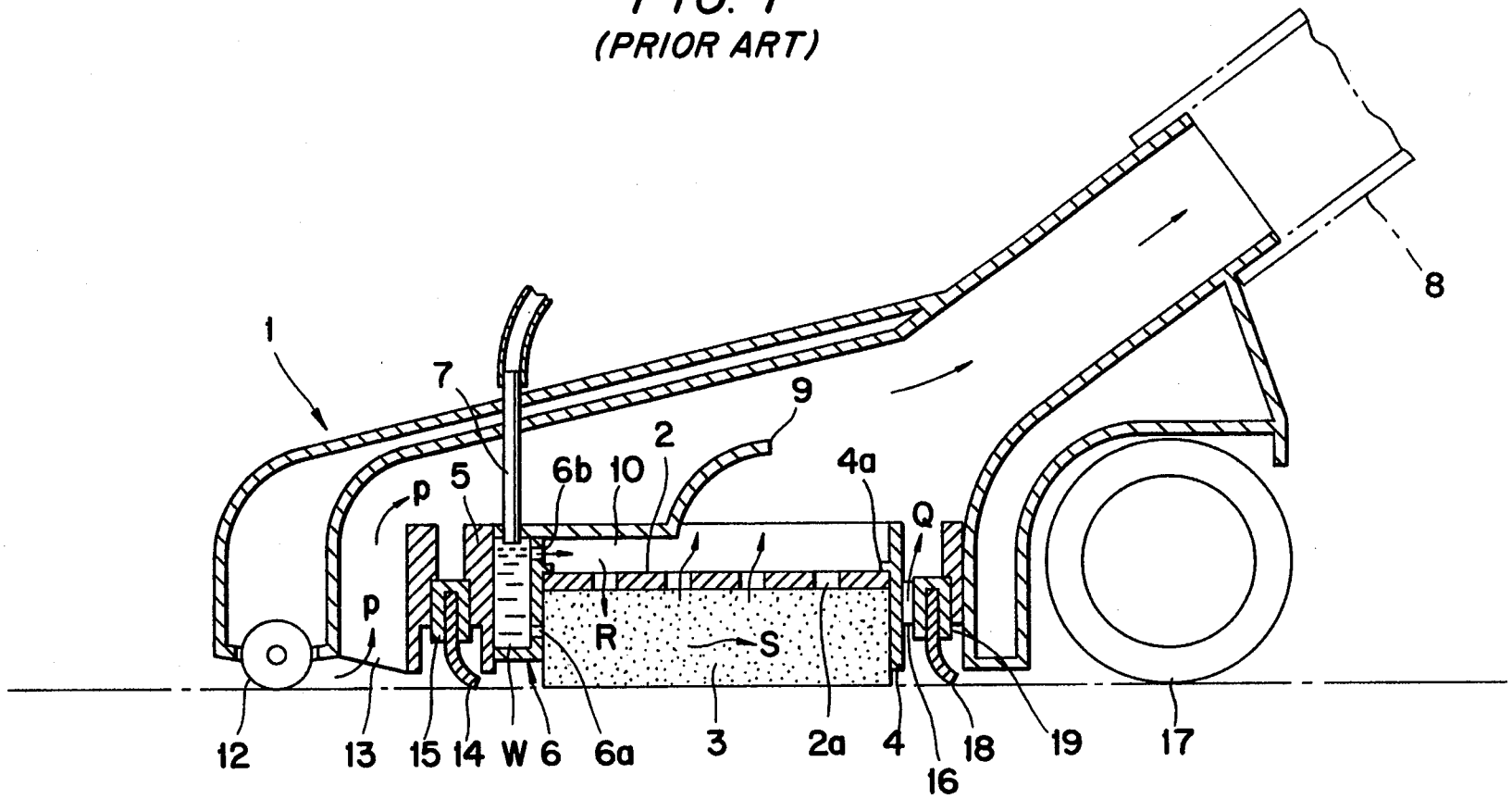
FIG. 1 (PRIOR ART)
FIG. 1 is a sectional drawing for illustrating a suction head of a conventional vacuum cleaner.
Figure 2:
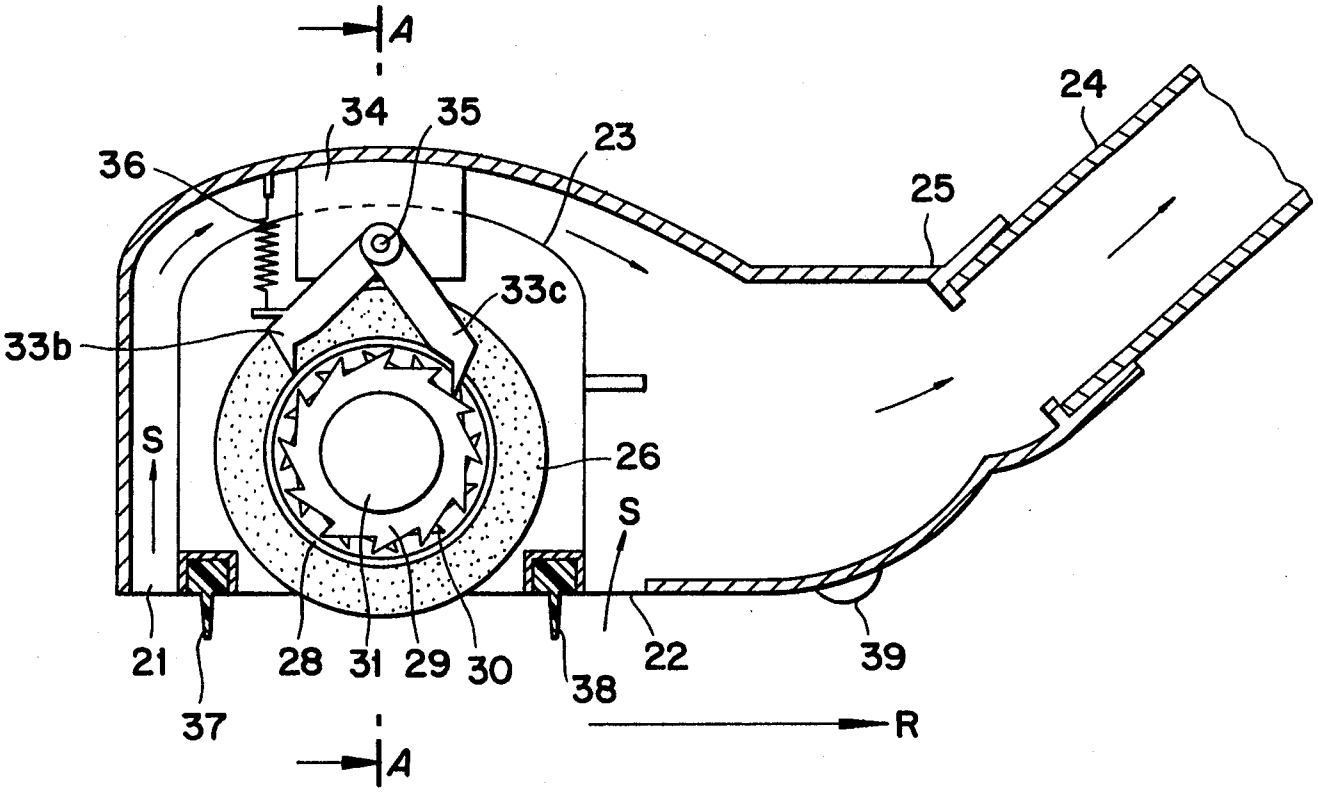
FIG. 2 is a sectional drawing for illustrating a suction head of a vacuum cleaner in accordance with an embodiment of the present invention.
Figure 3:
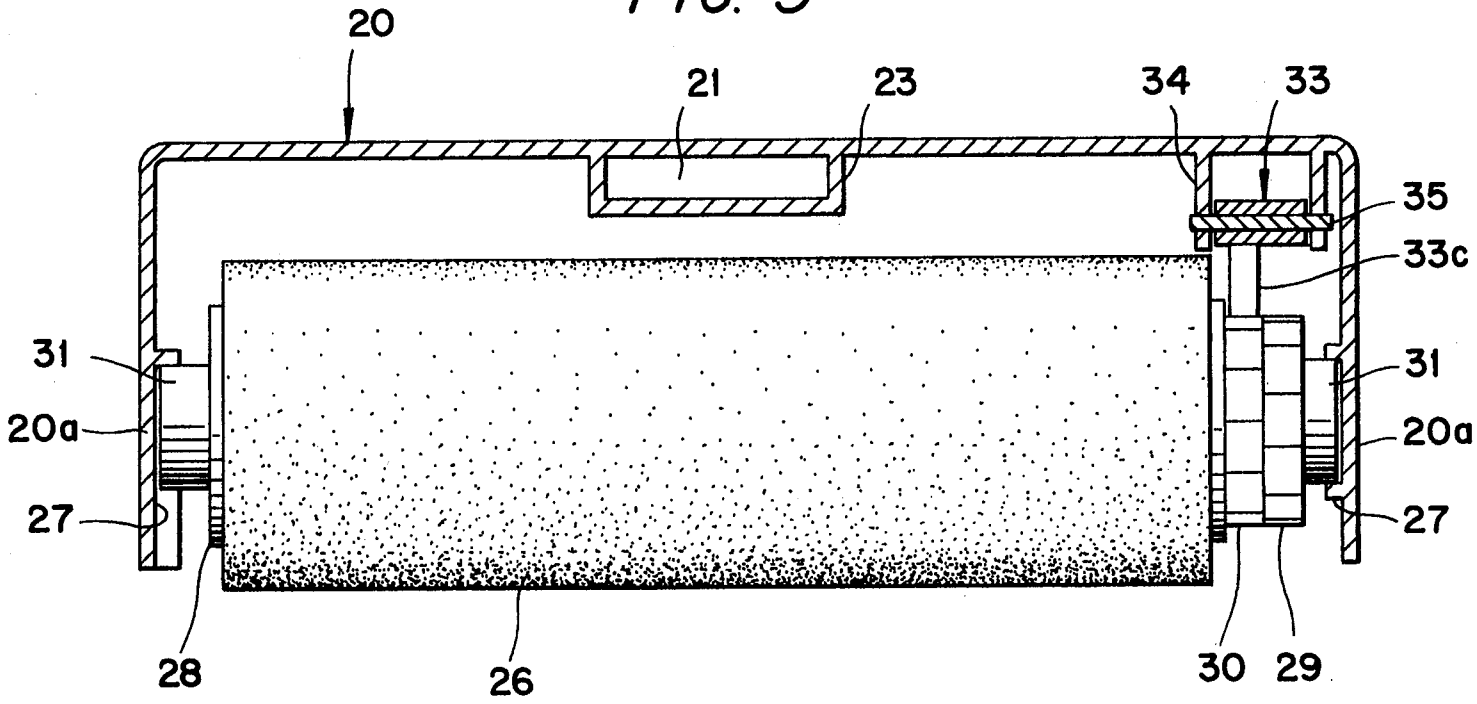
FIG. 3 is a sectional view taken along line A–B of FIG. 2.
Figure 4:
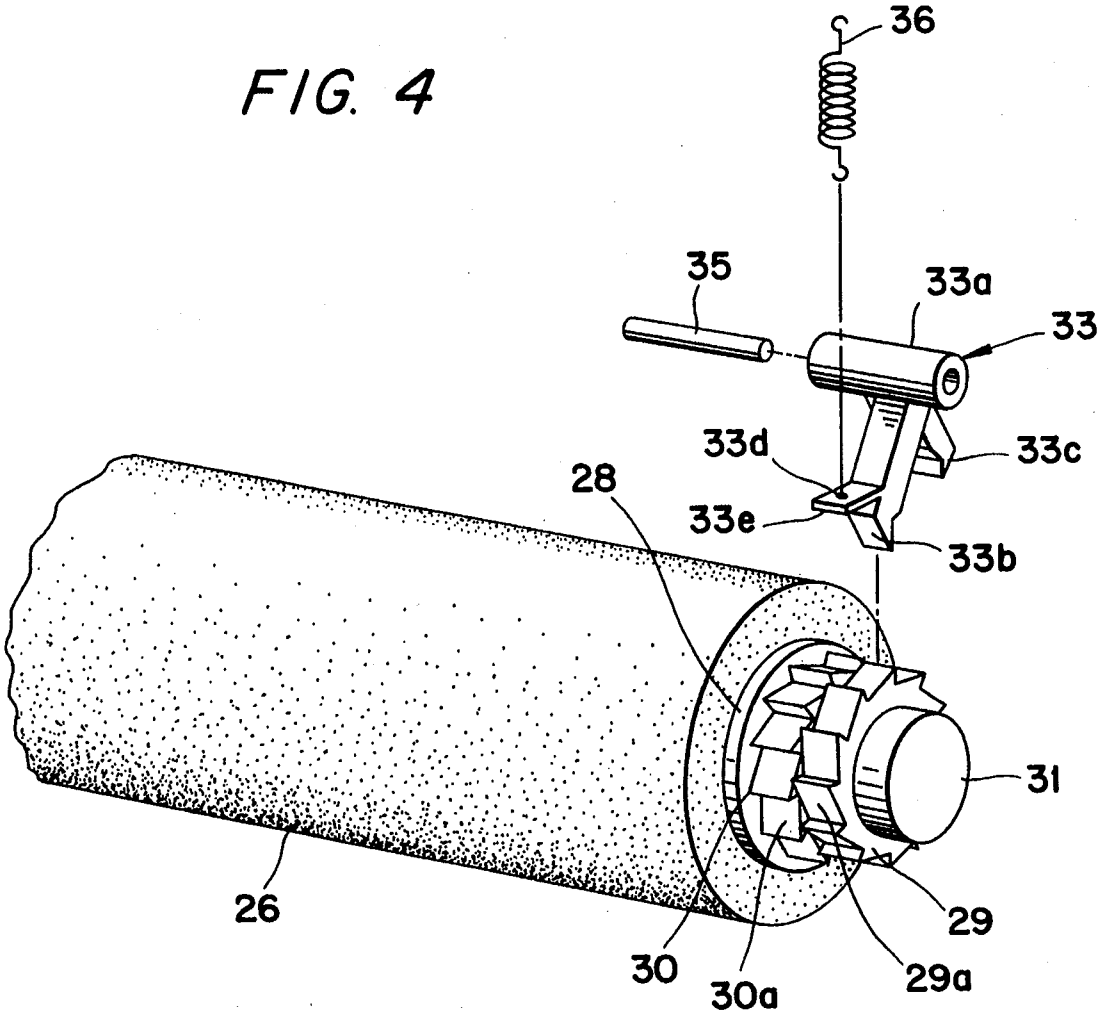
FIG. 4 is an exploded perspective view of a rag roll device of the present invention.

As illustrated in detail in FIGS. 2 and 4, the dust, wastes and/or the like are sucked in from the floor to be cleaned by a suction force generated in accordance with an activation of a suction means disposed within a body of the cleaner (not shown) and at the same time, a suction head 20 mounted with a rag roll 26 for a wet rag-wiping is integrally extruded with a main suction port 21 and an auxiliary port 22 in order to suck in the dust, wastes and/or the like from front/rear sides of the rag roll 26. The main suction port 21 and the auxiliary suction port 22 are connected to a connection 25 in order to be connected to a connecting tube 24, so that the sucked-in dust, wastes and/or the like can be guided into a waste storage in the body of the cleaner.

Meanwhile, between the main suction port 21 and the auxiliary suction port 22 of the suction head 20, the rag roll 26 is mounted for stationarily wet-wiping the floor in response to forwardly moving the suction head 20 and is so disposed that the same can be rotated clockwise by a predetermined angle in response to a backward movement of the suction head 20.

The rag roll 26 made of cotton, sponge, artificial paper or the like is formed in a cylindrical shape with a round axial hole in the center.

The rag roll 26 is releasably clamped to an exterior surface of a rag roll support means 28 on the same axis, so that the same 26 can wipe off the contamination supposedly caused by the dust, wastes and/or the like during a wet rag-wiping.

A main shaft 31 for supporting the rag roll 26 is inserted into a central piercing hole of the rag roll support means 28, and each end of the main shaft 31 is rotatably and releasably mounted to a shaft pad 27 formed on the inside of each of the side walls 20*a* of the suction head 20.

Furthermore, first and second ratchet wheels 29 and 30 having a plurality of teeth formed respectively in opposite directions are fixed to one end of the outer periphery of the main shaft 31 in order to control the rag roll support means 28 and the rag roll 26 in clockwise or counter-clockwise rotation.

Meanwhile, a support bracket 34 is integrally formed with an inner upper area of the suction head 20 located above the first and second ratchet wheels 29 and 30. The support braket 34 is mounted to a click means or pawl unit 33 by a shaft 35 which extends through a hole formed on a circular hub unit 33*a* of the click means 33, to provide for rotation of the click means 33.

The circular hub unit 33*a* of the click means 33 is integrally mounted to a first click or pawl 33*b* for controlling the rag roll 26 for clockwise rotation through a predetermined angle (here as much as an angle corresponding to one pitch of a tooth 30*a* in the second ratchet wheel 30) when the suction head 20 is drawn in the arrow direction R as shown in FIG. 2. This causes the first click 33*b* to mesh with a tooth 29*a* of the first ratchet wheel 29.

A second click or pawl 33*c* for regulating a counter-clockwise rotation of the rag roll 26 by meshing with teeth 30*a* of the second ratchet wheel 30 is integrally mounted with the circular unit 33*a* at a predetermined angular spacing with respect to the first click 33*b*.

Furthermore, a flange unit 33*e* with a fixed hole 33*d* in the center thereof is formed on an external side of the first click 33*b*, so that the flange can be fixed to an end of a coil spring fixed to the suction head 20.

In the aforesaid description, the rag roll 26, rag roll support means 28, first and second ratchet wheels 29 and 30 and main shaft 31 are so disposed that the same are rotated to the same direction at all times in accordance with forward and backward movements of the suction head 20.

A first guiding means 37 is disposed on a frontal lower area of a bulkhead 23 of the suction head 20, so that the dust, wastes and the like on the floor to be cleaned can be guided lengthwise to the main suction port 21.

A second guiding means 38 is disposed on a lower area between the bulkhead 23 and the auxiliary suction port 22 in order to avoid a rotation impediment of the rag roll caused by the dust, wastes and/or the like being squeezed between the rag roll 26 and the bulkhead 23, and at the same time, in order to have the dust, wastes and the like sucked in via the auxiliary suction port 22.

A caster 29 is mounted to a rear side of the auxiliary suction port 22 in order to guide the suction head 20 to be moved forward and backward, maintaining a horizontal level.

When, after an activation of the cleaner, the suction head 20 of the vacuum cleaner thus constructed is closely adhered to the floor to thereby be moved forwardly in an opposite direction from the arrow direction R illustrated in FIG. 2, the dust, wastes and/or the like littered on the floor are collected toward the suction port by the first and second guiding means 37 and 38 via the main suction port 21 and auxiliary port 22 formed on a bottom surface of the suction head 20 to thereby be sucked in along the arrow direction as illustrated in FIG. 2.

The sucked-in dust, wastes and/or the like are collected into a waste storage located in a body of the cleaner (not shown) through a coupling tube 24.

At this moment, the second click 33*c* of the click means 33 abuts a tooth 30*a* formed on a periphery of the second ratchet wheel 30, so that the rag roll 26 is held against rotation and, can contact the floor with such a huge frictional force that a clean wiping of the floor can be performed.

Next, when the suction head 20 is moved backward in the arrow direction R as illustrated in FIG. 2, the rag roll is rotated clockwise along with the shaft 31 for a predetermined extent as will be now explained.

At this moment, because the first and second ratchet wheels 29 and 30 mounted to one end of the main shaft 31 are rotated clockwise, the second click 33*c* positioned on a root area between the teeth 30*a* of the second ratchet wheel 30 is cammed up gradually along a slant of the tooth 30*a*.

However, because the first click 33*b* is formed on a periphery of the circular unit 33*a* of the click means 33 at a predetermined angle to the second click 33*c*, the second click 33*c* and the first click 33*b* perform a seesawing motion.

Accordingly, when the second click 33*c* rises up, being in touch with the slant of the tooth 30*a* formed on the second ratchet wheel 30, the first click 33*b* conversely descends against the force of the elastic material 36, to thereby mesh with a root area formed between teeth 29*a* of the first ratchet wheel 29, so that even the continued backward movement of the suction head 20 can not rotate the main shaft 31 any more, and the rag roll support means 28 and rag roll can not be rotated.

Thus, the rag roll 26 will have been rotated clockwise as much as a pitch of one tooth 30*a* formed on the periphery of the second ratchet wheel 30.

In other words, if a user moves the suction head 20 backward to thereby rotate the rag roll 26 clockwise and rotate the second ratchet wheel 30, the first click 33*b* and second click 33*c* perform a seesawing motion to thereby raise the second click 33*c* and lower the first click 33*b*.

Accordingly, the first click is meshed with the tooth 29*a* of the first ratchet wheel 29 to thereby stop the rotation of the rag roll support means 28, after the rag roll 26 connected on the same axis with the rag roll support means 28 has been rotated through a predetermined angle (i.e., an angle corresponding to a pitch of the tooth 30*a* formed on the periphery of the second ratchet wheel 30).

At this moment, the second click 33*c* becomes lowered by the force of the elastic material 36 to become meshed with the tooth 30*a* formed on the second ratchet wheel 30 to thereby block the rotation of the rag roll 26 and the rag roll support means 28 counter-clockwise, so that the main shaft 31 can not be rotated when the suction is subsequently moved forwardly.

Accordingly, because, whenever the suction head 20 is drawn, rearwardly part of the rag roll 26 contaminated by the wet-wiping is rotated clockwise by as much the pitch of as one tooth 30*a* formed on the second ratchet wheel 30, an uncontaminated part of the rag roll gets in contact with the floor to thereby perform a clean wiping of the floor.

As seen from the foregoing, according to the suction head of the vacuum cleaner provided by the present invention, the suction head can perform a wet-rag wiping of the floor with a huge frictional force by blocking the rotation of the rag roll during a forward movement. Conversely, when the suction head is moved backward to thereby rotate the rag roll by at least a predetermined angle and change a position of a face of the rag, will not be restricted to one part of the rag face to thereby extend a service life of the rag, and at the same time, a re-contamination caused by the rag roll can be prevented.

Having described a specific preferred embodiments of the invention with reference to the accompanying drawings, it is to be understood that the invention is not limited to the precise embodiment, and that various changes and modifications may be effected therein by one skilled in the art without departing from the scope or spirit of the invention as defined in the appended claims.

What is claimed:

1. A suction head for a vacuum cleaner, comprising:

a body forming:

a suction passage connectible with a suction source, and at least one downwardly open suction port communicating with said suction passage for sucking debris upwardly into said suction port from a floor as the suction head is moved in forward and rearward directions across the floor;

a rag roll device mounted on said body for rotation about an axis oriented transversely of said forward and rearward directions, said rag roll device being arranged to contact the floor to be subjected to a rotation-inducing force during movement of the suction head; and a rotation regulating mechanism mounted on said body and operably connected to said rag roll device for holding said rag roll device against rotation when said rag roll device is moved across the floor in one of said forward and rearward directions, so that said rag roll device performs a wiping action against the floor, and for automatically releasing said rag roll device for rotation about said axis in response to movement of said rag roll device across the floor in the other of said forward and rearward directions, so that different portions of said outer periphery of said rag roll device assume a floor-contacting position when said rag roll device is moved across the floor in said other direction.

2. A suction head according to claim 1 wherein said rotation regulating means permits said rotation of said rag roll device through a predetermined angle of rotation.

3. A suction head for a vacuum cleaner, comprising:

a body forming:

a suction passage connectible with a suction source, and at least one downwardly open suction port communicating with said suction passage for sucking debris upwardly into said suction port from a floor as the suction head is moved in forward and rearward directions across the floor;

a rag roll device mounted on said body for rotation about an axis oriented transversely of said forward and rearward directions, said rag roll device being arranged to contact the floor to be subjected to a rotation-inducing force during movement of the suction head; and rotation regulating means mounted on said body and operably connected to said rag roll device for holding said rag roll device against rotation so that said rag roll device performs a wiping action against the floor, and for periodically permitting said rag roll device to rotate about said axis so that different portions of said outer periphery of said rag roll device assume a floor-contacting position, said rotation regulating means arranged to permit said rotation of said rag roll device to occur only when the suction head is moved rearwardly.

4. A suction head according to claim 3, wherein said rotation regulating means includes a pawl device mounted for pivotal movement on said body, said pawl device including first and second interconnected pawls alternatingly engageable respectively with first and second sets of circumferentially spaced teeth disposed for rotation with said rag roll device.

5. A suction head according to claim 4, wherein said teeth of said first set are inclined oppositely relative to said teeth of said second set so that during forward moment of the suction head said first set of teeth cam said first pawl out of a tooth-contacting position, and during rearward movement of the suction head said second set of teeth cam said pawl out of a tooth-contacting position.

6. A suction head according to claim 3 including biasing means for biasing said pawl device in one direction of pivotal movement so that one of said pawls is constantly biased toward a tooth-contacting position rag roll device through a predetermined angle of rotation.

7. A suction head for a vacuum cleaner, comprising:

a body forming:

a suction passage connectible with a suction source, and at least one downwardly open suction port communicating with said suction passage for sucking debris upwardly into said suction port from a floor as the suction head is moved in forward and rearward directions across the floor;

a rag roll device mounted on said body for rotation about an axis oriented transversely of said forward and rearward directions, said rag roll device being arranged to contact the floor to be subjected to a rotation-inducing force during movement of the suction head; and rotation regulating means mounted on said body and operably connected to said rag roll device for holding said rag roll device against rotation so that said rag roll device performs a wiping action against the floor, and for periodically permitting said rag roll device to rotate about said axis so that different portions of said outer periphery of said rag roll device assume a floor-contacting position, said rotation regulating means arranged to permit said rotation of said rag roll device to occur only in one direction of rotation, said rotation regulating means including a pawl device mounted for pivotal movement on said body, said pawl device including first and second interconnected pawls alternatingly engageable respectively with first and second sets of circumferentially spaced teeth disposed for rotation with said rag roll device.

8. A suction head for a vacuum cleaner, comprising:

a body forming:

a suction passage connectible with a suction source, and at least one downwardly open suction port communicating with said suction passage for sucking debris upwardly into said suction port from a floor as the suction head is moved in forward and rearward directions across the floor;

a rag roll device mounted on said body for rotation about an axis oriented transversely of said forward and rearward directions, said rag roll device being arranged to contact the floor to be subjected to a rotation-inducing force during movement of the suction head;

rotation regulating means mounted on said body and operably connected to said rag roll device for holding said rag roll device against rotation so that said rag roll device performs a wiping action against the floor, and for periodically permitting said rag roll device to rotate about said axis so that different portions of said outer periphery of said rag roll device assume a floor-contacting position, and flexible wiper blades arranged on said body to contact the floor forwardly and rearwardly of said rag roll device.

9. A suction head according to claim 8, wherein said suction port is located forwardly of a forwardmost one of said wiper blades.

10. A suction head according to claim 9 including an additional suction port located rearwardly of a rearwardmost one of said wiper blades and communicating with said suction passage.

* * * * *